United States Patent [19]

Skaggs

[11] Patent Number: 4,471,902

[45] Date of Patent: Sep. 18, 1984

[54] CONTAINER COVER LOCKING ARRANGEMENT

[75] Inventor: Boyd T. Skaggs, Louisville, Ky.

[73] Assignee: Container Corporation of America, Chicago, Ill.

[21] Appl. No.: 469,645

[22] Filed: Feb. 25, 1983

[51] Int. Cl.[3] ..... B65D 5/66; B65D 5/28

[52] U.S. Cl. ..... 229/33; 229/44 R; 229/DIG. 9

[58] Field of Search ..... 229/45 R, 44 R, 43, 229/33, 36, 48 R, DIG. 9

[56] References Cited

U.S. PATENT DOCUMENTS

| | | | |
|---|---|---|---|
| 1,794,631 | 3/1931 | Luckett | 229/33 |
| 2,493,176 | 1/1950 | Whitehead | 229/36 |
| 2,675,160 | 4/1954 | Buttery | 229/45 |
| 2,764,336 | 9/1956 | White | 229/36 |
| 2,857,090 | 10/1958 | Fallert | 229/36 |
| 2,942,770 | 6/1960 | Eichorn | 229/33 |
| 2,995,290 | 8/1961 | Swanson | 229/33 |
| 3,468,469 | 9/1969 | Kossoff | 229/33 |
| 4,245,773 | 1/1981 | Stollberg | 229/33 |

FOREIGN PATENT DOCUMENTS

| | | | |
|---|---|---|---|
| 2407862 | 7/1979 | France | 229/33 |

*Primary Examiner*—William Price
*Assistant Examiner*—Gary E. Elkins
*Attorney, Agent, or Firm*—Richard W. Carpenter

[57] ABSTRACT

A self-contained, one-piece, collapsible container including a pair of co-planar top panels with depending inner side panels forming a cover structure for a tray-like body structure having lock tabs projecting from outer side panels thereof into apertures of the cover structure.

1 Claim, 6 Drawing Figures

CONTAINER COVER LOCKING ARRANGEMENT

BACKGROND OF THE INVENTION

1. Field of the Invention

This invention relates generally to collapsible containers and more particularly to a one-piece container including a pair of co-planar cover panels having interlocking engagement with the side panels of the container.

2. Description of the Prior Art

A prior art search in the U.S. Patent and Trademark Office directed to the subject matter of this application disclosed the following patents: U.S. Pat. Nos. 655,938; 1,522,311; 2,323,782; 3,352,053; 3,451,535; 3,912,155; Great Britain Pat. No. 909,552.

None of the prior art patents uncovered in the search discloses a one-piece collapsible container with integral tray and cover structures wherein the cover structure includes a pair of co-planar top panels having interlocking engagement with the adjacent side panels of the tray structure in the manner of the present invention.

SUMMARY OF THE INVENTION

An object of the present invention is to provide a one-piece collapsible container for use in holding or shipping a packaged article such as a carton of cigarettes.

A more specific object of the invention is the provision of a container of the type described which is entirely self contained and requires no outside securing means such as glue or staples to hold it together when assembled.

Another specific object of the invention is the provision, in a container of the type described, of a cover structure which includes a pair of co-planar panels having interlocking engagement with the side panels of the container tray structure by means of lock tabs which project from the side panels through openings in the cover structure.

These and other objects of the invention will be apparent from examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 3:
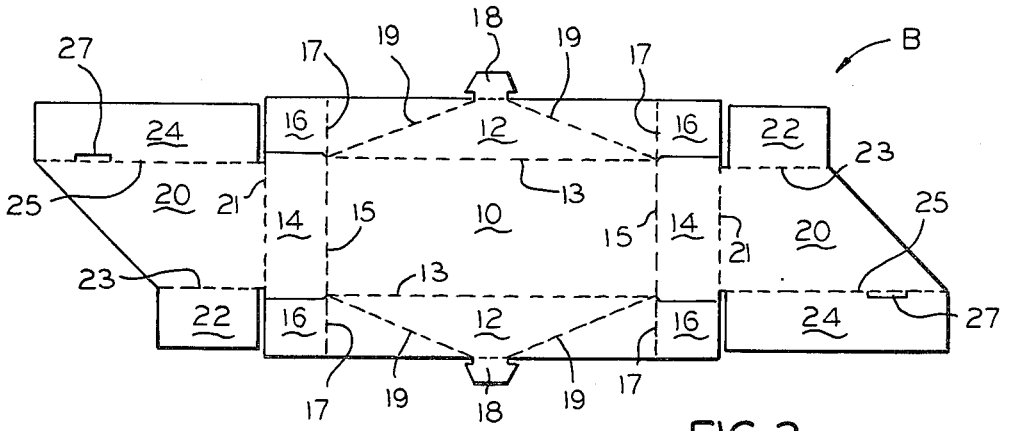
FIG. 3 is a plan view of blank of foldable sheet material from which the container illustrated in other views may be formed.
Figure 4:
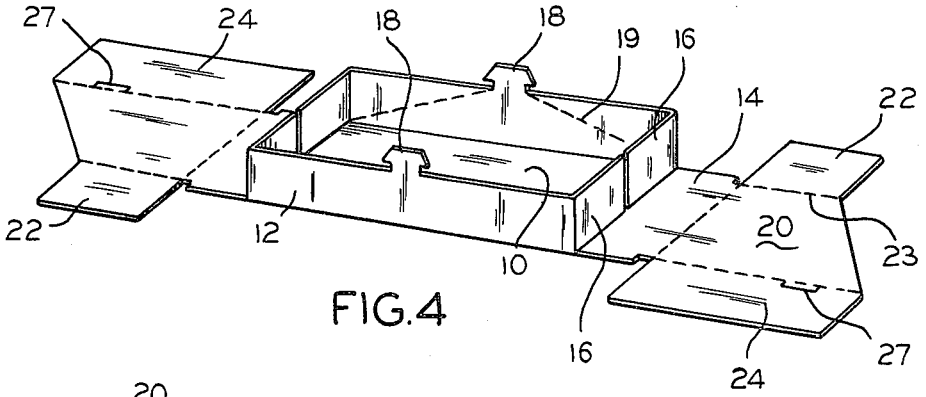
FIGS. 4, 5 and 6 are perspective views illustrating various stages in the assembly of the container from the blank.
Figure 1:
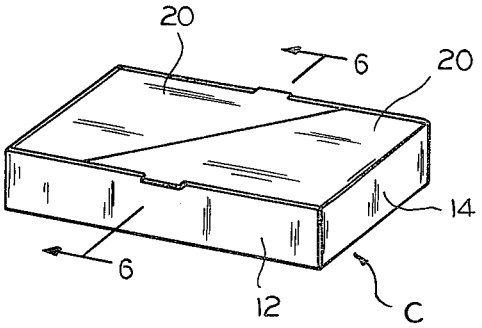
FIG. 1 is a perspective view of a container embodying features of the invention, as shown in the assembled condition.
Figure 2:
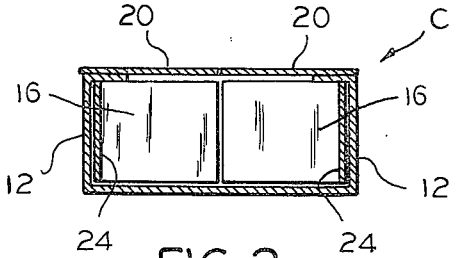
FIG. 2 is a transverse vertical sectional view taken on line 2—2 of FIG. 1.

Referring now to the drawings for a better understanding of the invention, it will be seen that the container indicated generally at C in FIGS. 1 and 2 may be formed from the unitary blank B of foldable sheet material illustrated in FIG. 3 of the drawings.

Figure 5:
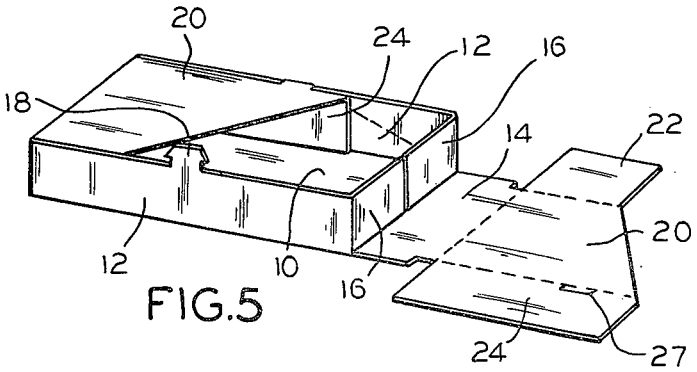
Figure 6:
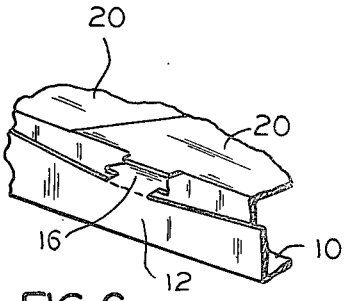

As best seen in FIGS. 3 and 5, container C comprises integral tray or body and cover structures. The body structure of the container includes a preferably rectangular bottom panel 10 having a pair of opposed outer side panels 12 foldably joined to opposite side edges thereof on fold lines 13 and a pair of outer end panels 14 foldably joined to opposite end edges thereof along fold lines 15. The body structure also may include pairs of corner flaps or inner end panels 16 which are foldably joined on fold lines 17 to opposite ends of side panels and folded at right angles to the side panels to lie against the inner faces of outer end panels 14. Projecting upwardly from each of the side panels 12 is a generally arrow-shaped lock tab 19, the purpose of which is described later in the application. Also, it should be noted, that each of the outer side panels 12 is provided with a pair of diagonally extending fold lines 19 which diverge downwardly from the upper central portion of the side panel. The purpose of these fold lines is important to the invention and is described later in the application.

The cover structure of the container includes a pair of cover sections each of which includes a preferably trapezoidal shaped top panel 20, foldably joined on fold 21 lines to an upper edge of an adjacent panel 14, and a pair of minor and major inner side panels 22 and 24, foldably joined to opposite side edges of top panel 20 along fold lines 23 and 25, respectively, and which are adapted to be inserted within the body structure of the container in face-to-face relation with the inner surfaces of outer side panels 12.

In order to lock the cover structure to the body structure, there are provided in each of the sections of the cover structure an aperture 27 which is located approximately in line with the fold line 25 connecting the top panel 20 to a major side inner side panel 24. When the cover is in a closed position the top panels 20 are in co-planar relationship and the lock tabs 18 extend through apertures 27 in the cover structure.

One of the unique features of this invention is the provision of the diagonal fold lines 19 in the outer side panels 12 which allow the cover structure to be locked to the body structure after the body structure has been filled with the article to be packaged. The diagonal fold lines 19 in the outer side panels 12 permit the outer side panels to be flexed, so there is room to fold the lock tabs 18 over at 90° angle to the side panels and insert them in the respective openings 27.

Thus, it will be appreciated that the invention provides a novel one-piece, collapsible, self-contained structure which can be maintained in assembled position without any outside securing means such as glue or staples.

I claim:

1. A self-contained, collapsible, one-piece container which can be assembled and locked without requiring outside securing means, said container being formed from a unitary blank of foldable sheet material, such as paperboard, and comprising:

(a) a bottom panel having opposed outer side and end panels foldably joined to side and end edges thereof and upstanding therefrom to form therewith a tray-like body structure;

(b) a pair of separate trapezoidal-shaped top panels foldably joined to upper edges or respective end panels and disposed to extend inwardly therefrom in generally co-planar relation with each other;

(c) said top panels having foldably joined to and depending from opposite side edges thereof inner side panels disposed in face-to-face relation with inner surfaces of said outer side panels and forming with said top panels a cover structure;

(d) two of said inner side panels each presenting a lock tab receiving opening adjacent an upper edge thereof;

(e) said outer side panels each having projecting from an upper edge thereof a lock tab adapted for insertion with an aligned aperture of a related inner side panel of said cover structure;

(f) each of said outer side panels presenting a pair of downwardly diverging fold lines which allow said outer side panel to be deflected outwardly to permit said body structure lock tabs to be readily inserted into said cover structure aperatures.

* * * * *